428-408 SR
2/20/79 XR 4,140,832

United States Patent [19]
Menegay
[11] 4,140,832
[45] Feb. 20, 1979

[54] ELECTROMOTIVE BRUSHES PRODUCED FROM MESOPHASE PITCH FIBERS

[75] Inventor: Daniel J. Menegay, Olmstead Township, Cuyahoga County, Ohio

[73] Assignee: Union Carbide Corporation, New York, N.Y.

[21] Appl. No.: 753,810

[22] Filed: Dec. 23, 1976

[51] Int. Cl.[2] ..... H01R 39/26
[52] U.S. Cl. ..... 428/288; 310/248; 310/253; 427/114; 428/290; 428/408; 428/902
[58] Field of Search ..... 310/251, 252, 253, 248; 427/114; 264/176 F; 428/290, 408, 902

[56] References Cited

U.S. PATENT DOCUMENTS

| | | | |
|---|---|---|---|
| 2,224,724 | 12/1940 | Elsey | 427/114 |
| 3,108,018 | 10/1963 | Lewis | 428/408 |
| 3,165,480 | 1/1965 | Churchill | 310/253 |
| 3,367,812 | 2/1968 | Watts | 156/155 |
| 3,406,126 | 10/1968 | Litant | 252/511 |
| 3,751,294 | 8/1973 | Fredman et al. | 310/253 |
| 3,829,327 | 8/1974 | Omori et al. | 423/447 |
| 3,960,601 | 6/1976 | Schultz | 136/122 |
| 3,976,729 | 8/1976 | Lewis et al. | 264/176 F |
| 3,996,048 | 12/1976 | Fredman et al. | 427/385 R |
| 4,032,607 | 6/1977 | Schultz | 156/148 |

*Primary Examiner*—James J. Bell
*Attorney, Agent, or Firm*—John S. Piscitello

[57] ABSTRACT

Electromotive brushes having improved commutating properties composed of a dense, rigid plate of self-bonded, non-woven carbon fibers formed from mesophase pitch fibers. The brushes are produced by spinning a mesophase pitch to form carbonaceous pitch fiber; disposing staple lengths of the spun fiber in intimately contacting relationship with each other in a non-woven fibrous web; heating the web produced in this manner in an oxidizing atmosphere to thermoset the surfaces of the fibers to an extent which will allow the fibers to maintain their shape upon heating to more elevated temperatures but insufficient to thermoset the pitch in the interior portions of the fibers to an extent which will prevent the pitch from flowing and exuding through surface pores or flaws in the fibers when the web is further heated to more elevated temperatures under compressive pressure; further heating the web containing the externally thermoset fibers under compressive pressure in an oxygen-free atmosphere to a temperature sufficiently elevated to cause the mesophase pitch in the unoxidized interior portions of the fibers to undergo liquid flow and exude through surface pores or flaws in the fibers and contact the surfaces of the adjacent fibers; continuing to heat the web in an oxygen-free atmosphere to a carbonizing temperature so as to expel hydrogen and other volatiles and produce a dense, rigid carbon body wherein the fibers are bonded to each other by infusible carbon bonds; optionally, further heating the carbon body to a graphitizing temperature in an oxygen-free atmosphere; and then impregnating the carbonized or graphitized body with a thermosetting resin and heating it at a temperature sufficiently elevated to cure the resin impregnant.

3 Claims, No Drawings

ELECTROMOTIVE BRUSHES PRODUCED FROM MESOPHASE PITCH FIBERS

BACKGROUND OF THE INVENTION

This invention relates to novel electromotive brushes having improved commutating properties.

Electromotive brushes have conventionally been made with lampblack base electrographite. As the operating conditions of motors and generators have become more demanding, however, a need has developed for electromotive brushes possessing improved commutation properties. Significant improvement in such properties have been attained with the advent of flexible brushes formed with carbon fibers. However, flexible brushes of this kind require an elaborate construction wherein the fiber ends are electroplated and held together by means of a metal container. Such construction not only significantly increases the cost of the brush, but also leaves a shortened brush length available for wear. In addition, such brushes exhibit unsatisfactory high friction and high contact drops when in operation, which cause undesirable heating effects and shorter brush life.

SUMMARY OF THE INVENTION

In accordance with the present invention, it has now been discovered that highly conductive, low cost, dense, rigid plates composed of self-bonded non-woven carbon fibers, and useful as electromotive brushes, can be produced by spinning a carbonaceous pitch having a mesophase content of from about 40 per cent by weight to about 90 per cent by weight to form carbonaceous pitch fiber; disposing staple lengths of the spun fiber in intimately contacting relationship with each other in a non-woven fibrous web; heating the web produced in this manner in an oxidizing atmosphere to thermoset the surfaces of the fibers to an extent which will allow the fibers to maintain their shape upon heating to more elevated temperatures but insufficient to thermoset the pitch in the interior portions of the fibers to an extent which will prevent the pitch from flowing and exuding through surface pores or flaws in the fibers when the web is further heated to more elevated temperatures under compressive pressure; further heating the web containing the externally thermoset fibers under compressive pressure in an oxygen-free atmosphere to a temperature sufficiently elevated to cause the mesophase pitch in the unoxidized interior portions of the fibers to undergo liquid flow and exude through surface pores or flaws in the fibers and contact the surfaces of the adjacent fibers; continuing to heat the web in an oxygen-free atmosphere to a carbonizing temperature so as to expel hydrogen and other volatiles and produce a dense, rigid carbon body wherein the fibers are bonded to each other by infusible carbon bonds; optionally further heating the carbon body to a graphitizing temperature in an oxygen-free atmosphere; and then impregnating the carbonized or graphitized body with a thermosetting resin and heating it at a temperature sufficiently elevated to cure the resin impregnant.

Electromotive brushes produced in this manner are characterized by high electrical anisotropy (greater than 8:1 up to in excess of 40:1) which helps impart to these materials their improved commutating properties. As a result, such brushes exhibit a higher current-carrying capacity and operate at a commutation latitude considerably higher than standard lampblack base electrographitic brushes. At the same time, the brushes of the present invention do not exhibit the high friction and high contact drops characteristic of flexible carbon fiber brushes. Furthermore, because the fibers are self-bonded, essentially the entire brush is available for wear, as in conventional brushes. In addition, the life of such brushes has been found to be superior to the life of both conventional brushes and flexible carbon fiber brushes.

DESCRIPTION OF THE PREFERRED EMBODIMENTS

While carbonaceous fibers can be spun from non-mesophase pitches, only mesophase pitches are employed in the present invention because of their ability to produce highly-oriented fibers which can be easily thermoset. Mesophase pitches are pitches which have been transformed, in whole or in part, to a liquid crystal or so-called "mesophase" state. Such pitches by nature contain highly oriented molecules, and when these pitches are spun into fibers, the pitch molecules are preferentially aligned by the spinning process along the longitudinal axis of the fiber to produce a highly oriented fiber.

Mesophase pitches can be produced in accordance with known techniques by heating a natural or synthetic carbonaceous pitch having an aromatic base in an inert atmosphere at a temperature about 350° C. for a time sufficient to produce the desired quantity of mesophase. When such a pitch is heated in this manner under quiescent conditions, either at constant temperature or with gradually increasing temperature, small insoluble liquid spheres begin to appear in the pitch which gradually increase in size as heating is continued. When examined by electron diffraction and polarized light techniques, these spheres are shown to consist of layers of oriented molecules aligned in the same direction. As these spheres continue to grow in size as heating is continued, they come in contact with one another and gradually coalesce with each other to produce larger masses of aligned layers. As coalescence continues, domains of aligned molecules much larger than those of the original spheres are formed. These domains come together to form a bulk mesophase wherein the transition from one oriented domain to another sometimes occurs smoothly and continuously through gradually curving lamellae and sometimes through more sharply curving lamellae. The differences in orientation between the domains create a complex array of polarized light extinction contours in the bulk mesophase corresponding to various types of linear discontinuity in molecular alignment. The ultimate size of the oriented domains produced is dependent upon the viscosity, and the rate of increase of the viscosity, of the mesophase from which they are formed, which, in turn are dependent upon the particular pitch and the heating rate. In certain pitches domains having sizes in excess of two hundred microns and as large as several thousand microns are produced. In other pitches, the viscosity of the mesophase is such that only limited coalescence and structural rearrangement of layers occur, so that the ultimate domain size does not exceed one hundred microns.

The highly oriented, optically anisotropic, insoluble material produced by treating pitches in this manner has been given the term "mesophase", and pitches containing such material are known as "mesophase pitches". Such pitches, when heated above their softening points, are mixtures of two immiscible liquids, one the optically anisotropic, oriented mesophase portion, and the other the isotropic non-mesophase portion. The term "mesophase" is derived from the Greek "mesos" or "intermediate" and indicates the pseudo-crystalline nature of this highly-oriented, optically anisotropic material.

Carbonaceous pitches having a mesophase content of from about 40 percent by weight to about 90 percent by weight are suitable for producing the highly oriented carbonaceous fibers from which the self-bonded webs employed in the present invention can be produced. In order to obtain the desired fibers from such pitch, however, the mesophase contained therein must, under quiescent conditions, form a homogeneous bulk mesophase having large coalesced domains, i.e., domains of aligned molecules in excess of two hundred microns. Pitches which form stringy bulk mesophase under quiescent conditions, having small oriented domains, rather than large coalesced domains, are unsuitable. Such pitches form mesophase having a high viscosity which undergoes only limited coalescence, insufficient to produce large coalesced domains having sizes in excess of two hundred microns. Instead, small oriented domains of mesophase agglomerate to produce clumps or stringy masses wherein the ultimate domain size does not exceed one hundred microns. Certain pitches which polymerize very rapidly are of this type. Likewise, pitches which do not form a homogeneous bulk mesophase are unsuitable. The latter phenomenon is caused by the presence of infusible solids (which are either present in the original pitch or which develop on heating) which are enveloped by the coalescing mesophase and serve to interrupt the homogeneity and uniformity of the coalesced domains, and the boundaries between them.

Another requirement is that the pitch be nonthixotropic under the conditions employed in the spinning ot the pitch into fibers, i.e., it must exhibit a Newtonian or plastic flow behavior so that the flow is uniform and well behaved. When such pitches are heated to a temperature where they exhibit a a viscosity of from about 10 poises to about 200 poises, uniform fibers may be readily spun therefrom. Pitches, on the other hand, which do not exhibit Newtonian or plastic flow behavior at the temperature of spinning, do not permit uniform fibers to be spun therefrom.

Carbonaceous pitches having a mesophase content of from about 40 percent by weight to about 90 percent by weight can be produced in accordance with known techniques, as aforesaid, by heating a natural or synthetic carbonaceous pitch having an aromatic base in an inert atmosphere at a temperature above about 350° C. for a time sufficient to produce the desired quantity of mesophase. By an inert atmosphere is meant an atmosphere which does not react with the pitch under the heating conditions employed, such as nitrogen, argon, xenon, helium, and the like. The heating period required to produce the desired mesophase content varies with the particular pitch and temperature employed, with longer heating periods required at lower temperatures than at higher temperatures. At 350° C., the minimum temperature generally required to produce mesophase, at least one week of heating is usually necesary to produce a mesophase content of about 40 percent. At temperatures of from about 400° C. to 450° C., conversion to mesophase proceeds more rapidly, and a 50 percent mesophase content can usually be produced at such temperatures within about 1–40 hours. Such temperatures are preferred for this reason. Temperatures above about 500° C. are undersirable, and heating at this temperature should not be employed for more than about 5 minutes to avoid conversion of the pitch to coke.

The degree to which the pitch has been converted to mesophase can readily be determined by polarized light microscopy and solubility examinations. Except for certain non-mesophase insolubles present in the original pitch or which, in some instances, develop on heating, the non-mesophase portion of the pitch is readily soluble in organic solvents such as quinoline and pyridine, while the mesophase portion is essentially insoluble.(1) In the case of pitches which do not develop non-mesophase insolubles when heated, the insoluble content of the heat treated pitch over and above the insoluble content of the pitch before it has been heat treated corresponds essentially to the mesophase content.(2) In the case of pitches which do develop non-mesophase insolubles when heated, the insoluble content of the heat treated pitch over and above the insoluble content of the pitch before it has been heat treated is not solely due to the conversion of the pitch to mesophase, but also represents non-mesophase insolubles which are produced along with the mesophase during the heat treatment. Pitches which contain infusible non-mesophase insolubles (either present in the original pitch or developed by heating) in amounts sufficient to prevent the development of homogeneous bulk mesophase are unsuitable for producing highly oriented carbonaceous fibers useful in the present invention, as noted above. Generally, pitches which contain an excess of about 2 percent by weight of such infusible materials are unsuitable. The presence of absence of such homogeneous bulk mesophase regions, as well as the presence or absence of infusible non-mesophase insolubles, can be visually observed by polarized light microscopy examination of the pitch (see, e.g., Brooks, J. D., and Taylor, G. H., "The Formation of Some Graphitizing Carbons," Chemistry and Physics of Carbon, Vol. 4, Marcel Dekker, Inc., New York, 1968, pp. 243–268; and Dubois, J., Agache, C., and White, J. L., "The Carbonaceous Mesophase Formed in the Pyrolysis of Graphitizable Organic Materials," Metallography 3, pp. 337–369, 1970). The amounts of each of these materials may also be visually estimated in this manner.

(1) The percent of quinoline insolubles (Q.I.) of a given pitch is determined by quinoline extraction at 75° C. The percent of pyridine insolubles (P.I.) is determined by Soxhlet extraction in boiling pyridine (115° C.).

(2) The insoluble content of the untreated pitch is generally less than 1 percent (except for certain coal tar pitches) and consists largely of coke and carbon black found in the original pitch.

Aromatic base carbonaceous pitches having a carbon content of from about 92 percent by weight to about 96 percent by weight and a hydrogen content of from about 4 percent by weight to about 8 percent by weight are generally suitable for producing mesophase pitches which can be employed to produce the fibers useful in the instant invention. Elements other than carbon and hydrogen, such as oxygen, sulfur and nitrogen, are undesirable and should not be present in excess of about 4 percent by weight. When such extraneous elements are present in amounts of from about 0.5 percent by weight to about 4 percent by weight, the pitches generally have a carbon content of from about 92–95 percent by weight, the balance being hydrogen.

Petroleum pitch, coal tar pitch and acenaphthylene pitch are preferred starting materials for producing the mesophase pitches which are employed to produce the fibers useful in the instant invention. Petroleum pitch can be derived from the thermal or catalytic cracking of petroleum fractions. Coal tar pitch is similarly obtained by the destructive distillation of coal. Both of these materials are commercially available natural pitches in which mesophase can easily be produced, and are preferred for this reason. Acenaphthylene pitch, on the other hand, is a synthetic pitch which is preferred because of its ability to produce excellent fibers. Acenaphthylene pitch can be produced by the pyrolysis of polymers of acenaphthylene as described by Edstrom et al. in U.S. Pat. No. 3,574,653.

Some pitches, such as flouranthene pitch, polymerize very rapidly when heated and fail to develop large coalesced domains of mesophase, and are, therefore, not suitable precursor materials. Likewise, pitches having a high infusible non-mesophase insoluble content in organic solvents such as quinoline or pyridine, or those which develop a high infusible non-mesophase insoluble content when heated, should not be employed as starting materials, as explained above, because these pitches are incapable of developing the homogeneous bulk mesophase necessary to produce highly oriented carbonaceous fibers. For this reason, pitches having an infusible quinoline-insoluble or pyridine-insoluble content of more than about 2 percent by weight (determined as described above) should not be employed, or should be filtered to remove this material before being heated to produce mesophase. Preferably, such pitches are filtered when the contain more than about 1 percent by weight of such infusible, insoluble material. Most petroleum and synthetic pitches have a low infusible, insoluble content and can be used directly without such filtration. Most coal tar pitches, on the other hand, have a high infusible, insoluble content and require filtration before they can be employed.

As the pitch is heated at a temperature between 350° C. and 500° C. to produce mesophase, the pitch will, of course, pyrolyze to a certain extent and the composition of the pitch will be altered, depending upon the temperature, the heating time, and the composition and structure of the starting material. Generally, however, after heating a carbonaceous pitch for a time sufficient to produce a mesophase content of from about 40 percent by weight to about 90 percent by weight, the resulting pitch will contain a carbon content of from about 94–96 percent by weight and a hydrogen content of from about 4–6 percent by weight. When such pitches contain elements other than carbon and hydrogen in amounts of from about 0.5 percent by weight to about 4 percent by weight, the mesophase pitch will generally have a carbon content of from about 92–95 percent by weight, the balance being hydrogen.

After the desired mesophase pitch has been prepared, it is spun into fiber by conventional techniques, e.g., by melt spinning, centrifugal spinning, blow spinning, or in any other known manner. As noted above, in order to obtain highly oriented carbonaceous fibers from which the self-bonded webs employed in the present invention can be produced the pitch must, under quiescent conditions, form a homogeneous bulk mesophase having large coalesced domains, and be nonthixotropic under the conditions employed in the spinning. Further, in order to obtain uniform fibers from such pitch, the pitch should be agitated immediately prior to spinning so as to effectively intermix the immiscible mesophase and non-mesophase portions of the pitch.

The temperature at which the pitch is spun depends, of course, upon the temperature at which the pitch exhibits a suitble viscosity, and at which the higher-melting mesophase portion of the pitch can be easily deformed and oriented. Since the softening temperature of the pitch, and its viscosity at a given temperature, increases as the mesophase content of the pitch increases, the mesophase content should not be permitted to rise to a point which raises the softening point of the pitch to excessive levels. For this reason, pitches having a mesophase content of more than about 90 percent are generally not employed. Pitches containing a mesophase content of from about 40 percent by weight to about 90 percent by weight, however, generally exhibit a viscosity of from about 10 poises to about 200 poises at temperatures of from about 310° C. to above about 450° C. and can be readily spun at such temperatures. Preferably, the pitch employed has a mesophase content of from about 45 percent by weight to about 75 percent by weight, most preferably from about 55 percent by weight to about 75 percent by weight, and exhibits a viscosity of from about 30 poises to about 150 poises at temperatures of from about 340° C. to about 440° C. At such viscosity and temperature, uniform fibers having diameters of from about 5 microns to about 25 microns can be easily spun. As previously mentioned, however, in order to obtain the desired fibers, it is important that the pitch be nonthixotropic and exhibit Newtonian or plastic flow behavior during the spinning of the fibers.

The carbonaceous fibers produced in this manner are highly oriented materials having a high degree of preferred orientation of their molecules parallel to the fibers axis, as shown by their X-ray diffraction patterns. This preferred orientation is apparent from the short arcs which constitute the (002) bands of the defraction pattern. Microdensitometer scanning ot the (002) bands of the exposed X-ray film indicate this preferred orientation to be generally from about 20° to about 35°, usually from about 25° to about 30° (expressed as the full width at half maximum of the azimuthal intensity distribution).

After the fiber has been spun, staple lengths of the fiber are formed into a non-woven web wherein the staple fiber lengths are disposed in intimately contacting relationship with each other. Preferably the staple lengths are produced by blow-spinning of the pitch, and the blow-spun fibers are disposed into a web directly from the spinnerette. This can be conveniently accomplished by positioning a screen in the vicinity of the spinnerette and reducing the pressure behind the screen so as to draw the blow-spun fibers onto the screen. The fibers are preferably deposited on the screen so as to produce a web having an areal density of about 0.05 – 0.5 kg./m$^2$ of screen surface. The screen employed is preferably in the form of an endless wire mesh conveyor belt which can be used to transport the web through an oxidizing atmosphere.

Alternatively, continuous fiber can be spun and then cut or chopped into a desired length before being processed to form a web. Any method, either wet or dry, which effects the disposition of such fibers in intimately contacting relation in a non-woven fibrous web can be employed. Air laying operations, such as carding or garnetting, which effect a relatively oriented disposition of fibers are suitable for this purpose. When a more random disposition of fibers is desired, conventional textile devices which effect the air laying of fibers in a random webbing can be employed.

The fibers can also be formed into a web by water laying the fibers using conventional paper making techniques. When such techniques are employed, the fibers are first cut to a length suitable for processing, e.g., about ¼ inch in length, homogeneously intermixed with water and a suitable binder, such as starch or other well known binder, to form an aqueous slurry, and then deposited from the slurry on a substrate to form a web. Generally, the web is formed either by running a dilute suspension of fibers onto the surface of a moving endless belt of wire cloth, through which excess water may be drawn, or by running an endless belt of wire cloth through a suspension of the fibers. In the first case, a part of the water is drawn off by gravity, a part is taken from the web by suction, and a part is removed by pressure. In the second case, a vacuum is maintained below the stock level in the cylinder in which the wire cloth is rotating and the web forms on the wire by suction. In either case, the thickness of the web is controlled by the speed of the conveyor belt, by the consistency of the fiber suspension, and by the amount of suspension permitted to flow onto the belt.

After the non-woven fibrous web has been formed, it is heated in an oxidizing atmosphere for a time sufficient to thermoset the surfaces of the fibers of the web to an extent which will allow the fibers to maintain their shape upon heating to more elevated temperatures but insufficient to thermoset the pitch in the interior portions of the fibers to an extent which will prevent the pitch from flowing and exuding through surface pores or flaws in the fibers when the web is further heated to more elevated temperatures under compressive pressure. Generally, thermosetting the fibers to an oxygen content of at least 1 percent by weight is necessary to allow them to maintain their shape upon heating to more elevated temperatures. Thermosetting can be continued up to an oxygen level of 12 percent without interrupting satisfactory flow of the pitch in the interior portions of the fibers upon further heating at more elevated temperatures, provides sufficient compressive pressure is applied to the web during such heating. When the web is so heated at more elevated temperatures, small droplets of molten pitch exude from the fibers at intervals along the fiber lengths and contact the surfaces of the adjacent fibers. The pressure applied to the web during such heating serves to compact the fibers and utilizes this bleeding to bond the fibers together into a dense, rigid, cohesive, self-bonded, mass. Upon further heating to a carbonizing temperature in an oxygen-free atmosphere so as to expel hydrogen and other volatiles, infusible carbon bonds are produced between the fibers.

As noted above, the non-woven fibrous web is preferably produced by blow-spinning staple lengths of fiber and collecting the blow-spun fibers on an endless wire mesh conveyor belt which can be used to transport the web through an oxidizing atmosphere. By varying the speed of this belt it is possible to expose the web to the oxidizing atmosphere for any desired length of time and thereby thermoset the fibers contained therein to any desired degree. The extent to which the fibers are oxidized, of course, will determine the degree to which they will bleed when heated to a temperature sufficiently elevated to cause the mesophase pitch in the unoxidized interior portions of the fibers to undergo liquid flow, i.e., the degree to which the pitch will exude through surface pores or flaws in the fibers. If desired, an oxidizing oven containing a number of zones having progressively higher temperature can be employed so as to allow the fibers to be gradually heated to the desired final oxidizing temperature. Because the oxidation reaction is an exothermic one, and hence difficult to control, the oven is suitably a convection oven in which the oxidizing atmosphere may be passed through the web and wire mesh conveyor belt so as to remove heat of reaction from the immediate vicinity of the fibers and maintain a more constant temperature. The oxidizing gas, of course, may be recirculated through the oven after passing through the web and conveyor belt. To help maintain the web securely against the belt and prevent the fibers from blowing around in the oven, the oxidizing gas should be circulated downward through the web and belt rather than upward. The rate of flow of the gas, as well as the temperature, should be independently controlled in each zone of the oven to allow temperature and gas flow through the web to be regulated as desired. Gas velocity through the web is suitably maintained at a rate of from about 0.3 to about 3 meters per minute. The temperature of the zones is maintained, e.g., at from about 175° C. in the first or entrance zone up to about 400° C. in the last or exit zone.

The oxidizing atmosphere employed to thermoset the fibers of the non-woven webs employed in the present invention may be pure oxygen, nitric oxide, or any other appropriate oxidizing atmosphere. Most conveniently, air is employed as the oxidizing atmosphere.

The time required to thermoset the surface of the fibers will, of course, vary with such factors as the particular oxidizing atmosphere, the temperature employed, the diameter of the fibers, the particular pitch from which the fibers are prepared, and the mesophase content of such pitch. Generally, however, thermosetting can be effected in relatively short periods of time, usually in from about 5 minutes to less than about 60 minutes.

The temperature employed to effect thermosetting of the fibers must, of course, not exceed the temperature at which the fibers will soften or distort. The maximum temperature which can be employed will thus depend upon the particular pitch from which the fibers were spun, and the mesophase content of such pitch. The higher the mesophase content of the fiber, the higher will be its softening temperature, and the higher the temperature which can be employed to effect thermosetting. At higher temperatures, of course, theremosetting can be effected in less time than is possible at lower temperatures. Fibers having a lower mesophase content, on the other hand, require relatively longer heat treatment at somewhat lower temperatures to render them infusible.

A minimum temperature of at least 250° C. is generally necessary to effectively thermoset the fibers. Temperatures in excess of 500° C. may cause melting and/or excessive burnoff of the fibers and should be avoided. Preferably, temperatures of from about 275° C. to about 400° C. are employed. At such temperatures, the required amount of thermosetting can usually be effected within from about 5 minutes to less than about 60 minutes.

After the fibers have been thermoset as required, they are heated under compressive pressure to a temperature sufficiently elevated to cause the mesophase pitch in the unoxidized interior portions of the fibers to undergo liquid flow and exude through surface pores or flaws in the fibers, e.g., at a temperature of from about 400° C. to about 700° C. During such heating, small droplets of pitch appear at intervals along the fiber lengths and come into contact with the surfaces of the adjacent fibers. The pressure applied to the web during such heating serves to compact the fibers and utilizes this bleeding to bond the fibers together into a dense, cohesive, self-bonded mass. When the web is then further heated to a carbonizing temperature in an oxygen-free atmosphere so as to expel hydrogen and other volatiles, infusible carbon bonds are formed between the fibers.

The pressure required to effect satisfactory compression and bonding of the fibers will, of course, vary with the degree to which the fibers have been thermoset, with the more highly oxidized fiber webs requiring more pressure than the lesser oxidized fiber webs. Generally, pressures of at least 5000 kPa are necessary to compress and bond the fibers into a platelike product having a density suitable for use as a brush material, e.g., in excess of 0.7 Mg./m$^3$. At times, pressures in excess of 10,000 kPa may be necessary to attain a satisfactory product. While the use of an extraneous binder is not necessary to produce the selfbonded plates of the present invention, a binder may be employed, if desired to increase the density of the plate. Such binder, e.g., a mesophase pitch such as that from which the fibers themselves are produced, may be admixed with the fibers before they are compressed.

Upon further heating to a carbonizing temperature, the compressed mass is eventually rendered totally infusible. Upon heating to a temperature of about 1000° C., a dense, rigid body having a carbon content greater than about 98 percent by weight is obtained. At temperatures in excess of about 1500° C., the body is substantially completely carbonized. Such heating should be conducted in an oxygen-free atmosphere, such as the inert atmospheres described above to prevent further oxidation of the fibers.

Usually, carbonization is effected at a temperature of from about 1500° C. to about 2500° C. so as to produce a substantially completely carbonized body having a density greater than 0.7 Mg./m.$^3$ Generally, residence times of from about 0.5 minute to about 180 minutes are employed. While more extended heating times can be employed with good results, such residence times are uneconomical and, as a practical matter, there is no advantage in employing such long periods. In order to ensure that the rate of weight loss of the fibers does not become so excessive as to disrupt the fiber structure, it is preferred to gradually heat the fibers to their final carbonization temperature.

After the web has been compressed and carbonized, it may be further heated in an oxygen-free atmosphere, such as the inert atmospheres described above, to a graphitizing temperature in a range of from above about 2500° C. to about 3300° C., preferably from about 2800° C. to about 3000° C. A residence time of about 1 minute is satisfactory, although both shorter and longer times may be employed, e.g., from about 10 seconds to about 30 minutes, or longer. Residence times longer than 30 minutes are uneconomical and unnecessary, but may be employed if desired.

The carbonized or graphitized body produced in this manner is then impregnated with a thermosetting resin and heated to a temperature sufficiently elevated to cause the impregnant to thermoset, i.e., cure. Impregnation can be effected by any suitable means of effectively introducing the impregnant into the pores of the body. For example, the resin to be employed may be dissolved or suspended in a suitable solvent or dispersing agent and introduced into the pores of the body using conventional vacuum-pressure cycles.

After the body has been impregnated to the desired degree, it is heated to a temperature sufficiently elevated to cause the thermosetting resin impregnant to cure, e.g., from about 100° C. to about 200° C. After curing, the impregnated body generally contains from about 10 parts by weight to about 30 parts by weight of thermoset resin per 100 parts by weight of the body, preferably from about 15 parts by weight to about 25 parts by weight of thermoset resin per 100 parts by weight of the body.

The thermosetting resins used to impregnate the carbonized or graphitized body include, among others, phenolic resins, epoxy resins, furfuryl resins, and the like. Phenolic resins of the novolac type are preferred. Such resins are produced by condensing phenols, such as phenol itself, or resorcinol, with aldehydes such as formaldehyde, furfuraldehyde, acetaldehyde, and the like. Preferably, a phenol-formaldehyde resin, is employed. Conventional hardening agents, such as paraformaldehyde or hexamethylenetetramine, which upon the application of heat generate formaldehyde which reacts with the novolac resin and causes it to crosslink, are employed in the curing of these resins. The hardener for the resin is employed in an amount sufficient to cure such resin to the thermoset state, i.e., in an amount which will provide sufficient formaldehyde to reach with and crosslink the resin.

Any inert solvent capable of dispersing or dissolving the thermosetting resin employed and vaporizable at a temperature lower than that at which the resin will cure can be employed. Generally, the thermosetting resin is present in the solution or dispersion in an amount of from about 5 percent by weight to about 75 percent by weight, preferably from about 20 percent by weight to about 50 percent by weight. Suitable solvents include, among others, saturated aliphatic hydrocarbons such as hexane, heptane, pentane, isooctane, purified kerosene, and the like; saturated cycloaliphatic hydrocarbons such as cyclopentane, cyclohexane, methylcyclopentane, dimethylcyclopentane, and the like; aromatic hydrocarbons such as benzene, toluene, xylene, and the like; and ketones such as acetone, and the like.

The impregnated bodies produced in this manner may then be cut into a desired shape and employed as an electromotive brush.

The following example is set forth for purposes of illustration so that those skilled in the art may better understand the invention. It should be understood that it is exemplary only, and should not be construed as limiting the invention in any manner.

EXAMPLE 1

A commercial petroleum pitch was treated to produce a mesophase pitch having a mesophase content of about 60 percent by weight. The precursor pitch had a density of 1.23 Mg./m.$^3$, a softening temperature of 122° C. and contained 1 percent by weight pyridine insolubles (P.I. was determined by Soxhlet extraction in boiling pyridine). Chemical analysis showed a carbon content of 94.1%, a hydrogen content of 5.56%, a sulfur content of 1.82% and 0.19% ash.

The mesophase pitch was produced by heating the precursor petroleum pitch at a temperature of about 400° C. for 18.5 hours under a nitrogen atmosphere.

After heating, the pitch contained 60.1 percent by weight pyridine insolubles, indicating that the pitch had a mesophase content of close to 60 percent. This pitch was then blow-spun through atomizing nozzles at a temperature of 370° C. to produce staple lengths of fiber approximately 1–3 inches in length and 8 micrometers in diameter. The blow-spun fibers were deposited in intimately contacting relationship with each other on a wire mesh conveyor belt positioned beside the nozzle block by reducing the pressure behind the conveyor belt so as to draw the blow-spun fibers onto the belt. The fibers were allowed to collect on the belt until a fibrous web having an areal density of about 0.25 kg./m.$^2$ accumulated.

The fibrous web produced in this manner was then transported on the conveyor belt through a 12-meter long forced-air convection oven at a speed of 0.6 meter/minute. The oven contained eight zones, each 1.5 meters in length, and the web was gradually heated from 175° C. in the first or entrance zone to 400° C. in the eighth or exit zone while air was passed downward through the web and conveyor belt at a velocity of about 2 meters/minute. The oxygen content of the fibers was increased to 10 weight percent as a result of this procedure.

The thermoset fibrous web was then cut into circular discs 5 inches in diameter and approximately 200 grams of the discs were stacked in parallel fashion in a cylindrical graphite mold having an inner diameter of 5 inches and an inner depth of 12 inches. A graphite plate was placed on the stacked discs. The cylinder was placed in a small ceramic silo, surrounded with coke particles, and heated. When the temperature reached 250° C., a pressure of 6895 kPa was applied (in a direction parallel to the length of the cylinder) and maintained while the temperature was raised to 500° C. at a rate of 100° C. per hour. After heating for 15 minutes at 500° C., the pressure was released and the mold allowed to cool. A nitrogen atmosphere was maintained inside the silo throughout the heating and cooling periods.

A completely self-bonded plate was obtained in this manner which could be freely handled without loss of fibers. The plate was 1.791 cms. thick, and had a bulk density of 0.864 Mg./m.$^3$ The plate produced in this manner was then heated to a temperature of about 1000° C. over a period of about 20 hours, and then to 3000° C. over a period of about 1 hour, and maintained at that temperature for 2 hours. After graphitization, the plate had a bulk density of 0.897 Mg./m.$^3$, an elastic modulus of 1.66 GPa, a with-grain electrical resistivity of $10 \times 10^{-4}$ ohm-centimeters, an against-grain electrical resistivity of $495 \times 10^{-4}$ ohm-centimeters, and a resistivity ratio of 49.5:1.

The graphitized plate was cut into brushes approximately 2.5 cm. × 6.25 cm. × 1.25 cm. The brushes were placed in a vacuum chamber which was then evacuated to a pressure of 29 inches of mercury vacuum. A solution containing 1 part by weight of a phenolic resin (Bakelite BRP-5012, manufactured by Union Carbide Corporation) dissolved in 2 parts by weight of acetone was then introduced into the chamber to a level about 2.5 cms. above the graphite pieces. After thirty (30) minutes had elapsed, a pressure of 80–90 psi. was applied and held for 1 hour.

The impregnated pieces were then heated to 50° C. over a 30 minute period, then from 50° C. to 75° C. in 15 minutes where the temperature was maintained for 30 minutes, and then from 75° C. to 150° C. in 1 hour and held at 150° C. for 3 hours. The resin impregnant was fully thermoset by this treatment.

The impregnated brushes produced in this manner were then tested on a dummy commutator (copper) where brush life, contact drop and friction can be measured for a specific current density, commutator temperature, rubbing speed, and spring pressure but in which no current switching occurs. After 67.5 hours at 75 apsi. current density, 8 lbs/sq. in. spring pressure, 8000 ft./min. rubbin speed, and 73° C. commutator temperature, the brushes showed a voltage drop of 3.14 volts and were determined to have a brush life of 5300 hours/inch and a coefficient of friction of 0.07. Conventional lampblack base electrographitic brushes in the same test showed a voltage drop of 2.56 volts and were determined to have a brush life of 1550 hours/inch and a coefficient of friction of 0.05.

When tested on a black band generator where commutating latitude could be measured by means of a "black" or sparkless commutation by adjusting the interpole current, at various current loads, until sparking occurred, the brushes prepared in accordance with the invention exhibited an average band (amperes) of sparkless commutation of 30.5 amperes as compared to an average band of 22.7 amperes for the conventional lampblack base electrographitic brushes. This test is described by J. C. Aydelott in "Black Band Method of Commutation Observations," Electrical Engineering, Vol. 60, pp. 446–451, June, 1941.

What is claimed is:

1. In an electromotive brush, the improvement wherein the brush is composed of a dense, rigid plate of self-bonded, non-woven carbon fibers formed from mesophase pitch fibers, said plate having a density in excess of 0.7 Mg./m.$^3$ and being impregnated with a thermoset resin.

2. An electromotive brush as in claim 1 wherein the fibers are graphite fibers.

3. An electromotive brush as in claim 1 wherein the fibers are non-graphitic carbon fibers.

* * * * *

UNITED STATES PATENT OFFICE

CERTIFICATE OF CORRECTION

Patent No. 4,140,832 Dated February 20, 1979

Inventor(s) Daniel J. Menegay

It is certified that error appears in the above-identified patent and that said Letters Patent are hereby corrected as shown below:

Summary sheet, "Schultz" should read -- Schulz -- (two occurrences).

Column 2, line 28, after "temperature" insert -- above --.

Column 4, line 29, "an" should read -- in --.

Column 5, line 10, "flouranthene" should read -- fluoranthene --.

Column 7, line 36, "provides" should read -- provided --.

Column 9, line 18, "selfbonded" should read--self-bonded --.

Column 9, line 19, insert a comma (,) after "desired".

Column 9, line 32, insert a comma (,) after "above".

Column 10, line 26, "reach" should read -- react --.

Column 12, line 21, "rubbin" should read -- rubbing --.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*